United States Patent [19]

Tanaka et al.

[11] 4,194,930

[45] Mar. 25, 1980

[54] ION-NITRIDING PROCESS

[75] Inventors: Akio Tanaka, Ono; Mizuo Edamura, Kobe; Satoshi Furuitsu, Kakogawa; Satoru Kunise, Akashi, all of Japan

[73] Assignee: Kawasaki Jukogyo Kabushiki Kaisha, Kobe, Japan

[21] Appl. No.: 953,204

[22] Filed: Oct. 20, 1978

[30] Foreign Application Priority Data

Oct. 20, 1977 [JP] Japan ..... 52/126605

[51] Int. Cl.[2] ..... C23C 11/16

[52] U.S. Cl. ..... 148/16.6; 204/192 N

[58] Field of Search ..... 148/16, 16.5, 16.6; 204/164, 177, 192 N; 315/111

[56] References Cited

U.S. PATENT DOCUMENTS

| | | | |
|---|---|---|---|
| 3,190,772 | 6/1965 | Berghaus et al. | 148/16.6 |
| 3,228,809 | 1/1966 | Berghaus et al. | 148/16.6 |
| 3,650,930 | 3/1972 | Jones et al. | 204/177 |
| 3,684,590 | 8/1972 | Podgurski | 148/16.6 |
| 3,968,019 | 7/1976 | Hanazono et al. | 204/192 N |

OTHER PUBLICATIONS

Mattox, "Recent Advances in Ion Plating", Proc. 6th Interntl. Vacuum Congr. 1974, pp. 443–450.

*Primary Examiner*—L. Dewayne Rutledge
*Assistant Examiner*—Peter K. Skiff
*Attorney, Agent, or Firm*—Fleit & Jacobson

[57] ABSTRACT

The present invention provides an ion-nitriding process wherein a workpiece having at least one aperture is subjected to a DC voltage in an atmosphere of nitrogen-containing gas, characterized in that a first nitriding step is carried out under a vacuum which is strong enough to suppress arc discharge on the workpiece, and a second nitriding step is carried out under a weaker vacuum as compared to that in the first step so that glow discharge is produced even in the aperture of the workpiece.

13 Claims, 4 Drawing Figures

ION-NITRIDING PROCESS

The present invention relates to ion-nitriding processes in which workpieces are subjected to glow discharges under an atmosphere of nitrogen-containing processing gas so that the gas is ionized and the resultant ions are bombarded upon the workpieces to effect nitriding.

Such an ion-nitriding process has been known as being able to provide a finely nitrided surface layer in a very short time. In the process, the workpiece is subjected to bombarding of nitrogen and hydrogen ions to be heated thereby. Such ion bombarding causes the workpiece to release Fe atoms which produce compounds with N atoms in the atmosphere and the resultant compounds are deposited on the workpiece surface. It has also been recognized that the ion bombarding has an effect of cleaning the workpiece surface so as to facilitate depositing the FeN compounds on the surface. In general, the process is carried out under a vacuum or an atmosphere of reduced pressure so that consumption of the processing gas is comparatively small and there is no risk of air pollution. In the process, use may be made of $NH_3$ gas which is dissolved to produce a mixture of nitrogen and hydrogen. Alternatively, a mixture of nitrogen and hydrogen may specially be provided for the purpose of obtaining an optimum ratio of the two components.

Conventionally, it has been a common practice to carry out the ion nitriding process under a negative pressure which is maintained at a substantially constant value throughout the process. For the ion-nitriding process, it is essential to provide a stabilized or steady glow discharge so that a uniform temperature distribution is established and, for the purpose, it is recommended to make the vacuum as strong as possible. However, where the workpiece is of a complicated configuration having narrow openings such as narrow slits or narrow apertures, there is a tendency that the glow discharge cannot extend deep into the openings because the width of glow is increased as the vacuum becomes stronger. Thus, it becomes difficult to accomplish the nitriding through the ion-nitriding process under a strong vacuum particularly at such narrow openings.

It may be possible to effect nitriding of such narrow openings through the ion process by weakening the vacuum of the atmosphere, however, such solution is not recommended since a steady glow discharge cannot be established under a weakened vacuum. Where the vacuum of the atmosphere is not adequately strong, there is a tendency for an appreciable extent of arc discharge to be produced, as soon as a DC voltage is applied, through surface contaminating matters such as oils and dusts which may remain on the workpiece surface even when the surface is carefully pretreated, for example, cleaning or buffing. Such arc discharge is particularly apt to be produced in the areas of the narrow openings and causes a local destruction of the workpiece material. Hitheretofore, in order to eliminate the above problems, it has been required to apply to the workpiece a careful pretreatment which is expensive and requires an extended time.

A similar problem is also experienced with regard to the ratio of nitrogen gas to hydrogen gas. The glow discharge is stabilized where the content of nitrogen is relatively small, however, it is extremely difficult to have the area of narrow openings nitrided. By increasing the nitrogen content, it may become possible to have the glow discharge extended deep into the narrow openings but there will be an increased possibility of the arc discharge produced through surface contaminating matters.

It is therefore an object of the present invention to provide an ion-nitriding process through which even an area of narrow opening can be nitrided without any appreciable problem.

Another object of the present invention is to provide an ion-nitriding process which is effective for a workpiece having narrow openings.

In order to accomplish the above and other objects, the ion-nitriding in accordance with the present invention is comprised of two essential steps. In the first step, the workpiece having at least one narrow opening is placed in an atmosphere containing at least nitrogen under a vacuum which is strong enough to suppress arc discharge and provide a steady glow discharge and thereafter subjected to a discharge voltage so that a glow discharge is produced substantially throughout at least the exposed surface of the workpiece. The exposed surface is then provided with a nitrided layer under a substantially uniform temperature distribution. In the second step, the vacuum of the atmosphere is lessened or weakened to such a value that the glow discharge can be extended into the opening and the workpiece is again subjected to the discharge voltage to effect nitriding at the opening area. It should of course be noted that in the second step the glow discharge may also be produced in the surface area to effect a further nitriding therein.

According to a preferable aspect of the present invention, the process is carried out in an atmosphere of a mixture of nitrogen and hydrogen with a mixing ratio changed between the first and second steps. In the first step, the ratio of nitrogen gas to hydrogen gas may be 1:3 to avoid instability of glow discharge but in the second step the amount of nitrogen gas may be increased so that the ratio becomes for example 3:1.

The above and other objects and features of the present invention will become apparent from the following description of a preferred embodiment making reference to the accompanying drawings, in which.

Figure 1:
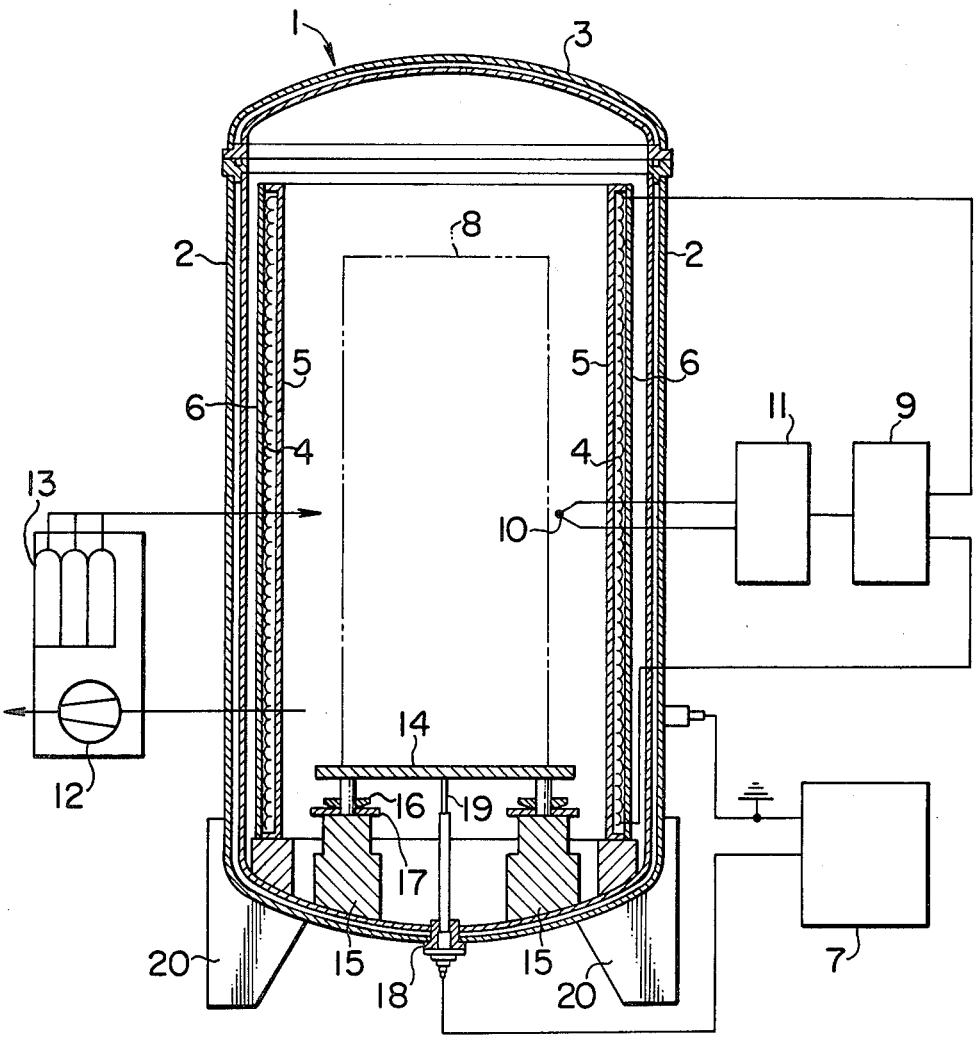
FIG. 1 is a diagrammatical illustration of an ion-nitriding apparatus which may be used for carrying out the process in accordance with the present invention.

Referring to the drawings, particularly to FIG. 1, the apparatus shown therein includes a nitriding tower 1 which is comprised of a cylindrical casing 2 and an upper closure 3 gas-tightly secured to the upper end of the casing 2. The casing 2 and the closure 3 are of double-walled constructions to provide cooling water jackets therein. In the tower 1, there is disposed a cylindrical heat radiating element 4 which may be constituted of a graphite cloth or any other suitable material. The heat radiating element 4 is positioned between inner and outer shields 5 and 6. The inner shield 5 is made of an electrically conductive material and functions to electrically shield the element 4 from the interior of the casing 2.

Within the inner shield 5, there is provided a work table 14 which is made of a conductive material and supported on an electrically insulative base 15 through conductive discs 16 and insulative plates 17. The table 14 is connected with a cathode terminal 19 which is mounted on the casing 2 through a fitting 18. The casing 2 is supported on legs 20.

A glow discharge power source 7 is connected on one hand with the inner shield 5 through the casing 2 and on the other hand with the table 14 through the cathode terminal 19 so that the inner shield 5 functions as an anode and the table 14 as a cathode. A workpiece 8 is placed on the table 14 as shown by a phantom line in FIG. 1. The power source 7 provides a supply of electric power in a manner that the discharge voltage, the duration time of discharge and the discharge wave form are appropriately controlled.

The heat radiating element 4 is connected with an AC power source 9 which is controlled by means of a temperature control device 11 having a temperature sensing thermocouple 10. The temperature in the casing 2 is therefore sensed by the thermocouple 10 and the temperature control device 11 controls the AC power source 9 in accordance with the temperature sensed by the thermocouple 10.

The inside of the casing 2 is further connected with an evacuating pump to apply a vacuum pressure to the tower 1. The inside of the casing 2 is also connected with a gas supply device 13 which supplies nitrogen and hydrogen gases in a controlled manner.

Figure 2:
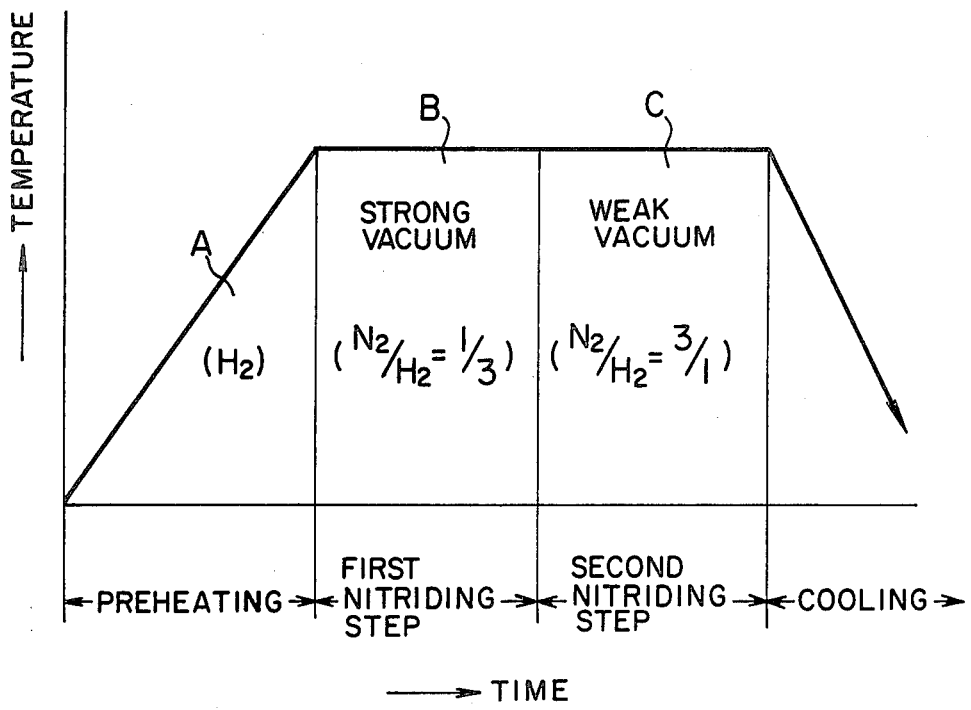
FIG. 2 is a diagram showing a typical example of the process in accordance with the present invention.

In operation, the evacuating pump 12 is at first operated to evacuate the tower 1 so that a vacuum pressure of, for example, 1 to 10 torr is maintained therein. Then, hydrogen gas is supplied to the tower 1 by the gas supply device 13 and the power source 9 is energized to generate heat in the element 4. At the same time, the power source 7 is energized so that a DC voltage is applied between the inner shield 5 and the table 14 to produce a glow discharge. The workpiece 8 is then heated by the glow discharge and the heat generated at the element 4, to a temperature between 300 and 570° C., preferably 550 and 560° C., under which the workpiece 8 can readily be nitrided. The glow discharge further has an effect of cleaning the workpiece surface through a reducing function. The step is shown in FIG. 2 by an area A.

Then, the first nitriding step is carried out by applying into the tower 1 a mixture of nitrogen and hydrogen with the vacuum pressure in the tower maintained between 1 and 5 Torr. The workpiece 8 is maintained at a desired temperature by means of the heat generated by the element 4 under the control of the device 11, and the DC voltage applied from the power source 7 is increased until a glow discharge is produced. Since the relatively strong vacuum is maintained in the tower 1, a stable glow discharge is produced on the exposed surface of the workpiece 8 except those areas where relatively narrow openings such as small holes and slits exist. Generation of arc is significantly suppressed and a uniformly nitrided layer is formed. In this instance, the size or width of the glow discharge is relatively large due to the strong vacuum, so that the discharge glow bridges the openings in the workpiece and the insides of the openings cannot be nitrided.

It is preferable in the first nitriding step to decrease the rate of nitrogen gas to as small as possible with respect to hydrogen gas. For example, the nitrogen-to-hydrogen ratio may be as small as 1:3 so that a further stability is provided in the glow discharge. The recommended value of the nitrogen-to-hydrogen ratio depends on the strength of the vacuum in the tower 1. When the vacuum is relatively weak, the amount of nitrogen should be decreased with respect to hydrogen. However, when the vacuum is sufficiently strong, nitrogen may be increased so that the nitrogen-to-hydrogen ratio becomes as high as 1:3. The first nitriding step is shown by the area B in FIG. 2 in which the nitrogen-to-hydrogen ratio is shown as being 1:3, as an example.

Thereafter, the second nitriding step is carried out under a decreased or weakened vacuum. In this step, the size or width of the glow is reduced due to the weakened vacuum so that the glow can extend into the openings such as small holes and narrow slits. Thus, nitriding is carried out in the areas where such openings exist. In this instance, since the exposed surface area of the workpiece has already been nitrided through the first nitriding step, there is least possibility that discharge arc is produced in the surface area even under the weak vacuum in this second nitriding step. Further, the insides of the openings have relatively small surface areas so that there is less possibility that discharge arc is produced therein even under a weak vacuum. Thus, it is possible to suppress generation of discharge arc as small as possible while providing a nitrided layer throughout the surface of the workpiece including the exposed surface and the inside of the openings. The pressure under which the second nitriding step is carried out may depend on the size of the openings but a preferable range is 3 to 10 Torr. In the second nitriding step, the nitrogen-to-hydrogen ratio may be increased, for example, to 3:1 from the 1:3 ratio of the first step. Then, the size of the glow is further decreased so that the discharge glow can be extended into even fine openings. The step is shown by the area C in FIG. 2. After the second nitriding step, the workpiece is cooled.

EXAMPLE 1

Figure 3:
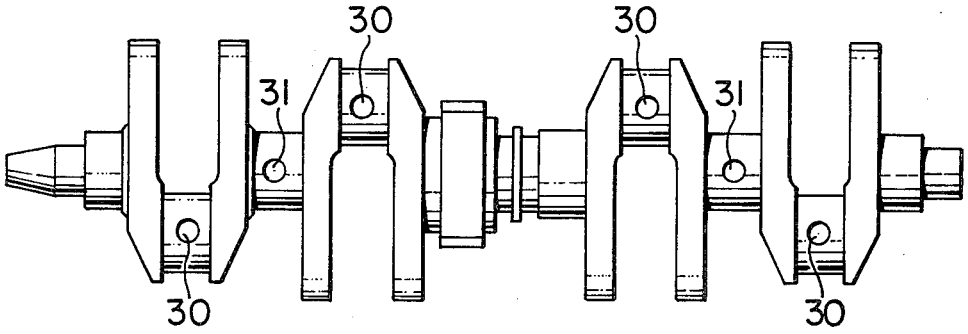
FIG. 3 is an elevational view showing a crankshaft to which the process of the present invention can be applied; and, FIG. 4 is a sectional view of a test piece.

A crankshaft for a motorcycle engine as shown in FIG. 3 was ion-nitrided in accordance with the present invention. The crankshaft had through holes 30 of 4 mm in diameter in the crankpins and through holes 31 of 5 mm in diameter in the shaft portion. In the first step, the workpiece was heated to 550° C. under an atmosphere of hydrogen and then the first ion-nitriding step was carried under the atmosphere of a mixture of nitrogen and hydrogen having the nitrogen-to-hydrogen ratio of 2:1, the atmosphere being maintained at a vacuum pressure of 1 Torr. After 2 hours of the first nitriding step, the vacuum was weakened to 3 Torr, and the second ion-nitriding step was carried out for two hours under the mixture of the same mixing ratio. It has been observed that in the first nitriding step stable discharge glow is produced in the exposed surface of the workpiece except the inside areas of the through holes without producing any appreciable arc discharge. In the second nitriding step, it has been observed that stable discharge glow is extending into the inside areas of the through holes and there was no appreciable arc discharge.

EXAMPLE 2

Figure 4:
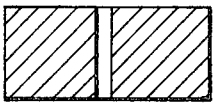

A test piece as shown in FIG. 4 having a thickness of 30 mm and formed with a through hole of 4.0 mm in diameter was nitrided in accordance with the present invention. The test piece was maintained at 550° C. during the process. In the first ion-nitriding step, a relatively strong vacuum of 1 Torr. was maintained and, in the second ion-nitriding step, the vacuum was weakened to 3 Torr. The nitrogen-to-hydrogen ratio was maintained at 2:1 throughout the nitriding steps. As in Example 1, a satisfactory result was obtained.

EXAMPLE 3

A test piece as shown in FIG. 4 and having a through hole of 1.5 mm in diameter was heated to 550° C. and nitrided in accordance with the present invention. In the first ion-nitriding step, the processing tower was maintained at a vacuum of 5 Torr. and the vacuum was weakened to 7.5 Torr. in the second nitriding step. The nitrogen-to-hydrogen ratio was maintained at 2:1 throughout the first and second nitriding steps. A satisfactory result was observed as in the previous Examples.

EXAMPLE 4

A crankshaft as shown in FIG. 3 was ion-nitrided in accordance with the present invention. The process was carried out maintaining the temperature at 550° C. In the first ion-nitriding step, the vacuum pressure was 3 Torr. and the nitrogen-to-hydrogen ratio was 1:3. In the second ion-nitriding step, the vacuum was weakened to 5 Torr. and the nitrogen-to-hydrogen ratio was changed to 3:1. A satisfactory result was observed.

The invention has thus been shown and described with reference to specific examples, however, it should be noted that the invention is in no way limited to the details of the examples but changes and modifications may be made without departing from the scope of the appended claims.

We claim:

1. In an ion-nitriding process including the steps of subjecting a workpiece having at least one aperture to a DC voltage in an atmosphere of nitrogen-containing gas so as to produce a glow discharge on the workpiece, the improvement comprising a first nitriding step which is carried out under a vacuum which is strong enough to suppress arc discharge on the workpiece, and a second nitriding step which is carried out under a vacuum which is weak as compared with the vacuum in the first nitriding step, so that glow discharge is produced even in the aperture of the workpiece.

2. A process in accordance with claim 1 in which said nitrogen-containing gas is a mixture of nitrogen and hydrogen.

3. A process in accordance with claim 2 in which the ratio of nitrogen and hydrogen is changed between the first and second nitriding steps.

4. A process in accordance with claim 3 in which said ratio of nitrogen to hydrogen is increased in the second nitriding step as compared with that in the first nitriding step.

5. A process in accordance with claim 1 in which said first nitriding step is preceded by a preheating step which is carried out by producing a glow discharge on the workpiece in an atmosphere of hydrogen.

6. A process in accordance with claim 1 in which the vacuum in the first nitriding step is between 1 and 5 Torr and that in the second nitriding step is between 3 and 10 Torr.

7. A process in accordance with claim 4 in which the ratio of nitrogen gas to hydrogen gas in the first nitriding step is as low as 1:3.

8. A process in accordance with claims 4 or 7 in which the ratio of nitrogen gas to hydrogen gas in the second nitriding step is as high as 3:1.

9. A process in accordance with claim 5 in which the workpiece is heated to a temperature between 300° and 570° C.

10. A process in accordance with claim 9 in which the workpiece is heated to a temperature between 550° and 560° C.

11. A process in accordance with claim 10 in which the workpiece is first heated to about 550° C. under an atmosphere of hydrogen, the first nitriding step is carried out under an atmosphere of a mixture of nitrogen and hydrogen present in about a 2:1 ratio and a vacuum pressure of about 1 Torr, and the second nitriding step is carried out in the same gaseous atmosphere as the first nitriding step, but at vacuum pressure of about 3 Torr.

12. A process in accordance with claim 2 in which the nitriding steps are carried out at a temperature of about 550° C. and under an atmosphere of a mixture of nitrogen and hydrogen present in about a 2:1 ratio, the vacuum pressure of the first nitriding step being about 5 Torr and the vacuum pressure of the second nitriding step being about 7.5 Torr.

13. A process in accordance with claim 4 in which the nitriding steps are carried out at a temperature of about 550° C., the first nitriding step being in an atmosphere of nitrogen and hydrogen present in a ratio of about 1:3 and under a vacuum pressure of about 3 Torr, the second nitriding step being in an atmosphere of nitrogen and hydrogen present in a ratio of about 3:1 and under a vacuum pressure of about 5 Torr.

* * * * *